US006923163B2

(12) United States Patent
Yamazaki

(10) Patent No.: US 6,923,163 B2
(45) Date of Patent: Aug. 2, 2005

(54) FUEL INJECTION CONTROLLER AND CONTROLLING METHOD

(75) Inventor: Shigeru Yamazaki, Odawara (JP)

(73) Assignee: Mikuni Corporation, Tokyo (JP)

( * ) Notice: Subject to any disclaimer, the term of this patent is extended or adjusted under 35 U.S.C. 154(b) by 0 days.

(21) Appl. No.: 10/475,730

(22) PCT Filed: Mar. 24, 2003

(86) PCT No.: PCT/JP03/03509

§ 371 (c)(1),
(2), (4) Date: Dec. 16, 2003

(87) PCT Pub. No.: WO03/081008

PCT Pub. Date: Oct. 2, 2003

(65) Prior Publication Data

US 2004/0134468 A1 Jul. 15, 2004

(30) Foreign Application Priority Data

Mar. 26, 2002 (JP) ..... 2002-086304

(51) Int. Cl.[7] ..... F02D 41/20; F02M 51/06
(52) U.S. Cl. ..... 123/490; 361/153
(58) Field of Search ..... 123/490; 361/139, 361/152–156

(56) References Cited

U.S. PATENT DOCUMENTS

| | | | | |
|---|---|---|---|---|
| 3,945,362 A | * | 3/1976 | Neuman et al. | 123/606 |
| 4,452,210 A | * | 6/1984 | Sasayama et al. | 123/490 |
| 5,375,575 A | | 12/1994 | Ohishi et al. | 123/446 |
| 6,031,707 A | | 2/2000 | Meyer | 361/153 |

FOREIGN PATENT DOCUMENTS

| | | |
|---|---|---|
| DE | 19907505 | 9/1999 |
| EP | 0563760 A2 | 10/1993 |
| EP | 0669457 A1 | 8/1995 |
| EP | 0671557 A1 | 9/1995 |
| EP | 0671558 A1 | 9/1995 |
| GB | 2334623 | 8/1999 |
| JP | 4-153541 | 5/1992 |
| JP | 5-272377 | 10/1993 |
| JP | 5-272390 | 10/1993 |
| JP | 5-272391 | 10/1993 |
| JP | 5-272392 | 10/1993 |
| JP | 10-77925 | 3/1998 |
| JP | 11-280527 | 10/1999 |
| JP | 2003-113732 | 4/2003 |

* cited by examiner

*Primary Examiner*—Tony M. Argenbright
(74) *Attorney, Agent, or Firm*—Wenderoth, Lind & Ponack, L.L.P.

(57) ABSTRACT

A fuel injection control apparatus and fuel injection method are provided for injecting a suitable fuel with a quick response in accordance with variations in required fuel injection amounts, while improving the energy efficiency, and enabling support for an electromagnetic fuel injection apparatus. The control apparatus controls the electromagnetic fuel injection apparatus that pressurizes fuel to be injected, and has a driving circuit for driving a solenoid for fuel injection, a driving signal generating circuit for generating a solenoid driving signal based on an injection cycle signal for specifying a fuel injection period and a PWM cycle signal to provide to the driving circuit, and a control circuit for generating the PWM cycle signal with a duty ratio corresponding to a required fuel injection amount, and providing the PWM cycle signal and the injection cycle signal to the driving signal generating circuit.

18 Claims, 12 Drawing Sheets

FUEL INJECTION CONTROLLER AND CONTROLLING METHOD

TECHNICAL FIELD

The present invention relates to an electronic fuel injection control method and apparatus for providing fuel to an internal combustion engine, and more particularly, to a fuel injection control method and apparatus for promptly responding to variations in required fuel injection amounts from the internal combustion engine, and precisely injecting the required fuel injection amounts.

BACKGROUND ART

In internal combustions engines for motor vehicles including two-wheeled vehicles, the most important factor in getting the best performance from an internal combustion engine to respond to variations in required fuel injection amounts is to provide a suitable amount of fuel to the internal combustion engine at a suitable timing.

In an electronic fuel injection apparatus which injects fuel from a fuel injection nozzle, the fuel is controlled to a predetermined pressure using a fuel pump and a pressure regulator instead of using a carburetor. Properly controlling an operation time (nozzle open time) of the fuel injection nozzle enables accurate fuel injection control corresponding to required fuel injection amounts. Therefore, in recent years, particularly in four-wheeled vehicles, the electronic fuel injection system has been widely applied, substituting for the conventional carburetor system.

In the control of opening and closing a fuel injection nozzle, the nozzle is opened by applying a voltage to a solenoid coupled to the nozzle so as to inject the fuel, and is closed by interrupting the applied voltage so as to suspend the fuel injection.

FIG. 15 illustrates an example of a driving control circuit according to the conventional technique for driving a solenoid for fuel injection (hereinafter, referred to as a "solenoid" as appropriate) 11 in the aforementioned fuel injection apparatus. In the driving control circuit as illustrated in FIG. 15, a driving signal is input from an external control circuit (not shown), and when the driving level becomes a low level, an FET (Field-Effect Transistor) 12 coupled to the solenoid 11 turns ON, thereby starting the fuel injection.

In the example as illustrated in FIG. 15, the driving signal transmitted from the external control circuit is a pulse signal with continuous predetermined cycles, and the pulse signal turns ON and OFF repeatedly in a predetermined duty ratio (a ratio of ON time to a cycle). When the FET 12 is switched from OFF to ON, the power supply voltage, (for example, DC 12V) is applied to the solenoid 11, and a current starts to flow into the solenoid 11. Since the solenoid 11 is an inductive load, the current that passes through the solenoid (solenoid current) is zero at the time the FET 12 turns ON, and gradually increases for a period of time when the FET 12 is ON. Then, when the FET 12 is switched from ON to OFF, the solenoid current flows back to a fly-wheel diode 13, where the power is consumed and decreases gradually. At a time when the solenoid current decreases below a predetermined level, the fuel injection from the injection nozzle (not shown) is suspended.

However, in order to promptly respond to variations in required fuel injection amounts from the engine side, there is a case where it is necessary to hasten the decreasing time of the solenoid current subsequent to the FET 12 turning OFF so as to enable precise control of injection time. Therefore, in order to reduce the fuel injection duration time from the injection nozzle as much as possible after the FET 12 turns OFF, the solenoid 11 is provided with a variety of snubber circuits 14 as illustrated in FIGS. 16(*a*) to 16(*d*).

However, even when the driving circuit as illustrated in FIG. 15 is provided with a snubber circuit as illustrated in FIGS. 16(*a*) to 16(*d*), and a pulse signal is used as a driving signal which has continuous predetermined cycles and a predetermined duty ratio, since the current which passes through the solenoid 11 is a large current (of a few amperes), it is not possible to hasten the decreasing time of the solenoid current, and it is difficult to perform appropriate fuel injection having a quick response to rapid variations in required fuel injection amounts.

Further, when the solenoid current is dissipated simply as heat in the snubber circuit, corresponding to the dissipation, the energy efficiency of the entire engine system decreases and a battery with a greater capacity is required.

Recently, the inventors of the present invention have developed a fuel injection apparatus (hereinafter referred to as an "electromagnetic fuel injection apparatus") using an electromagnetic fuel injection pump that pressurizes the fuel to be injected, as distinguished from the conventional type of fuel injection system that injects fuel that is pressurized with a fuel pump and regulator and then provides the fuel therefrom.

In the electromagnetic fuel injection apparatus, as distinguished from the conventional fuel injection apparatus, there are characteristics that the fuel injection amount is greatly affected by the solenoid current level as well as the solenoid driving time duration. Further, when a pulse width of the driving signal is wide, excessive currents flow into the solenoid, and current exceeding a level required for predetermined fuel injection are wastefully consumed. Furthermore, it is required to extremely shorten a pulse width during idle engine operation so as to secure a fuel injection amount at the time the nozzle is fully opened such as a time when the engine operates at high speed. However, there are limitations in decreasing a pulse width below a predetermined time duration due to issues such as inoperative time taken to start fuel injection after applying the voltage to the solenoid.

In view of the foregoing, it is an object of the present invention to provide a fuel injection control apparatus and fuel injection method which inject a suitable fuel having a quick response to variations in required fuel injection amounts from the engine side, while improving the energy efficiency, and particularly, to support an electromagnetic fuel injection apparatus.

SUMMARY OF THE INVENTION

In order to achieve the above object, the present invention provides a fuel injection control apparatus which controls an electromagnetic fuel injection apparatus that pressurizes fuel to be injected, and which has a driving means for driving a solenoid for fuel injection, a driving signal generating means for generating a solenoid driving signal based on an injection cycle signal for specifying a fuel injection period and a PWM cycle signal (Pulse Width Modulation cycle signal) to provide to the driving means, and a control means for generating the PWM cycle signal with a duty ratio corresponding to a required fuel injection amount, and providing the PWM cycle signal and the injection cycle signal to the driving signal generating means.

Thus, in the present invention, by using two signals, i.e., the injection cycle signal for specifying a fuel injection period and the PWM cycle signal with a duty ratio corresponding to a required fuel injection amount, the fuel injection control is made possible which enables precise control of fuel injection amount and further enables a quick response to variations in required fuel injection amount.

The duty ratio of the PWM cycle signal is capable of being maintained at a constant value during a period of one fuel injection cycle at idle operation and constant operation where the engine operates stably, while being varied during a period of one fuel injection cycle corresponding to rapid variations in required fuel injection amount.

The fuel injection control apparatus further has a coil current detecting means for measuring a coil current passed through the solenoid for fuel injection, and corresponding to the measured coil current level, adjusts the duty ratio of the PWM cycle signal. In this way, the present invention improves characteristics of the electromagnetic fuel injection apparatus whose fuel injection amount is affected by the solenoid current level.

The fuel injection control apparatus further has a capacitor that is coupled to charge the energy released by suspending driving of the solenoid for fuel injection, and a discharge control circuit to reuse the energy charged on the capacitor as energy for driving the solenoid. The discharge control circuit has a switching means for providing the energy charged on the capacitor to the solenoid when a voltage exceeding a power supply voltage is charged on the capacitor and the injection cycle signal is ON.

It is thereby possible to reuse the energy released from the solenoid to improve the energy efficiency while reducing a battery capacity mounted on a vehicle. Further, the discharge control enables greatly reduced inoperative time taken to start the fuel injection after applying the voltage to the solenoid.

The control means provides to the driving means a solenoid driving signal in a range of not causing the fuel injection before outputting the injection cycle signal for specifying the fuel injection period. It is thereby possible to further reduce the inoperative time.

Further, the present invention provides a fuel injection control method which is a method for controlling an electromagnetic fuel injection apparatus that pressurizes fuel to be injected, and which has the steps of generating a PWM cycle signal with a duty ratio corresponding to a required fuel injection amount, outputting the PWM cycle signal with an injection cycle signal for specifying a fuel injection period, generating a solenoid driving signal based on the injection cycle signal and PWM cycle signal, and driving a solenoid for fuel injection using the solenoid driving signal.

The method is provided with the step of driving a solenoid for fuel injection using the solenoid driving signal, and further with the steps of measuring a coil current passed through the solenoid for fuel injection, and corresponding to the measured coil current level, adjusting the duty ratio of the PWM cycle signal. It is thereby made possible to improve characteristics of the electromagnetic fuel injection apparatus whose fuel injection amount is affected by the solenoid current level.

DETAILED DESCRIPTION OF THE INVENTION

Embodiments of the present invention will be specifically described below with reference to the accompanying drawings.

Figure 2:
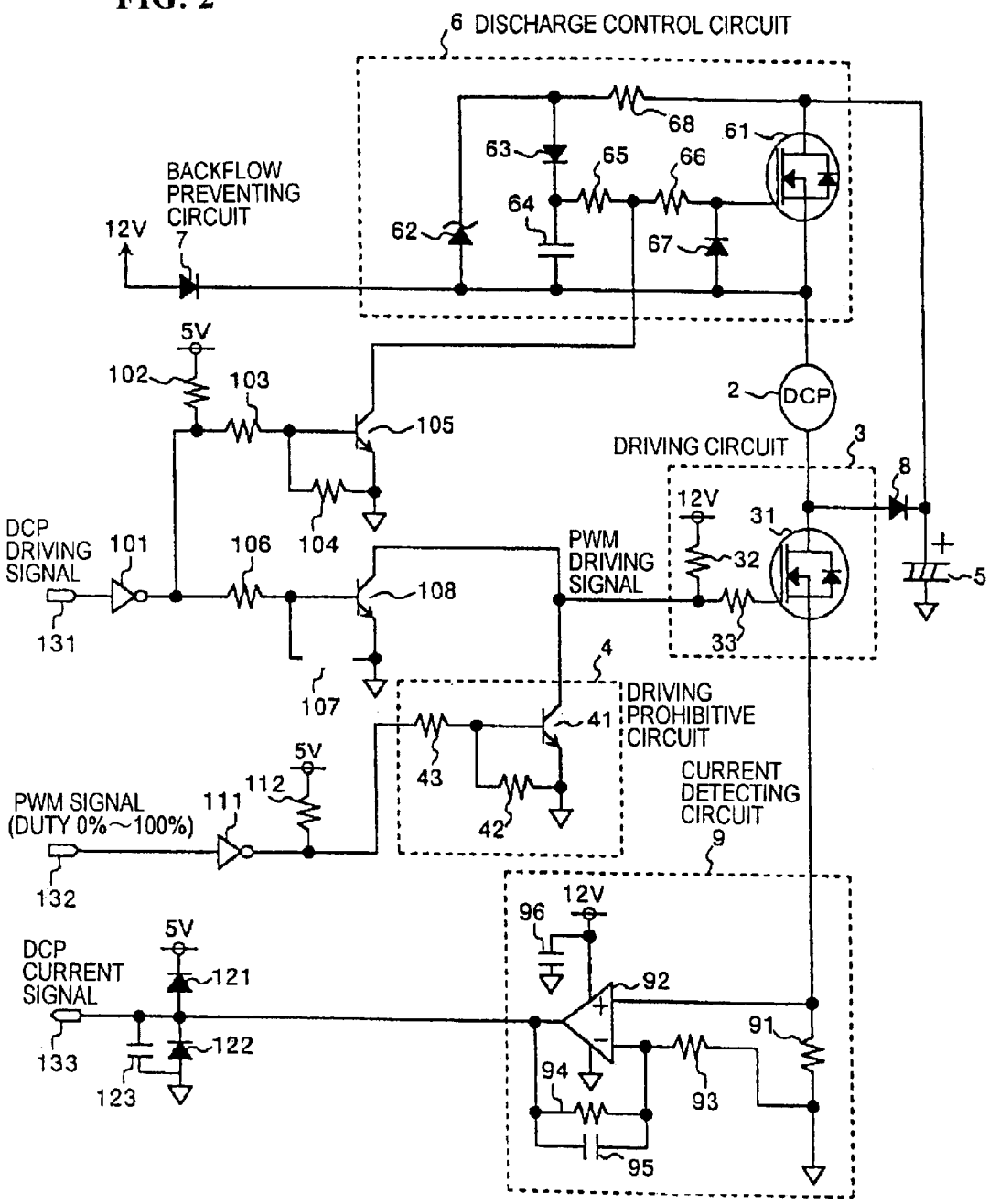
FIG. 2 shows an example of circuitry constituting the fuel injection control apparatus according to the present invention.
Figure 12:
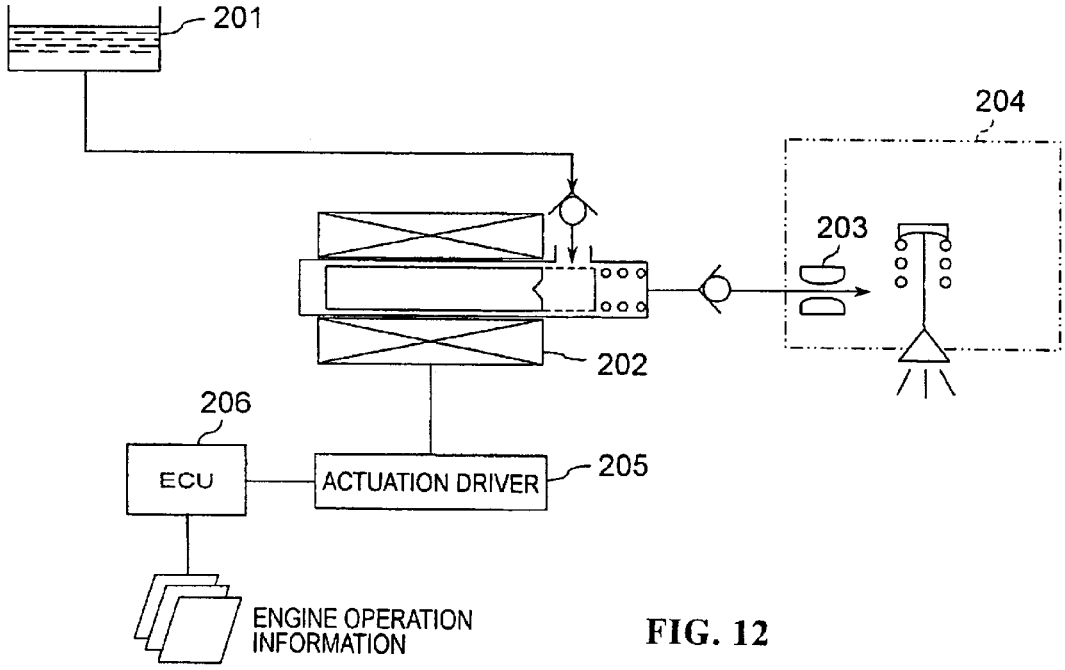
FIG. 12 shows an example of a fuel injection system (electromagnetic fuel injection system) where the fuel injection control apparatus is applied to an electromagnetic fuel injection apparatus.

FIG. 12 shows an example of a fuel injection system (electromagnetic fuel injection system) where a fuel injection control apparatus according to the present invention is applied to an electromagnetic fuel injection apparatus. As shown in FIG. 2, the electromagnetic fuel injection system has as a basic configuration a plunger pump 202 that is an electromagnetic driving pump for pressurizing the fuel in a fuel tank 201 to provide the pressurized fuel, an inlet orifice nozzle 203 having an orifice portion through which the pressurized fuel passes that is pressurized to a predetermined pressure in the plunger pump 202 and provided therefrom, an injection nozzle 204 that injects the fuel into an intake passage (of an engine) when a pressure of the fuel passed through the inlet orifice nozzle 203 is not less than a predetermined pressure, and a control unit (ECU) 206 configured to output a control signal to plunger pump 202 and other elements based on operation information of the engine. A control means in the fuel injection control apparatus according to the present invention corresponds to an actuation driver 205 and the control unit 206. The control unit 206 is comprised of a microprocessor (or one-chip microprocessor) and an interface, external memory and other elements connected to the microprocessor (not shown).

Figure 1:
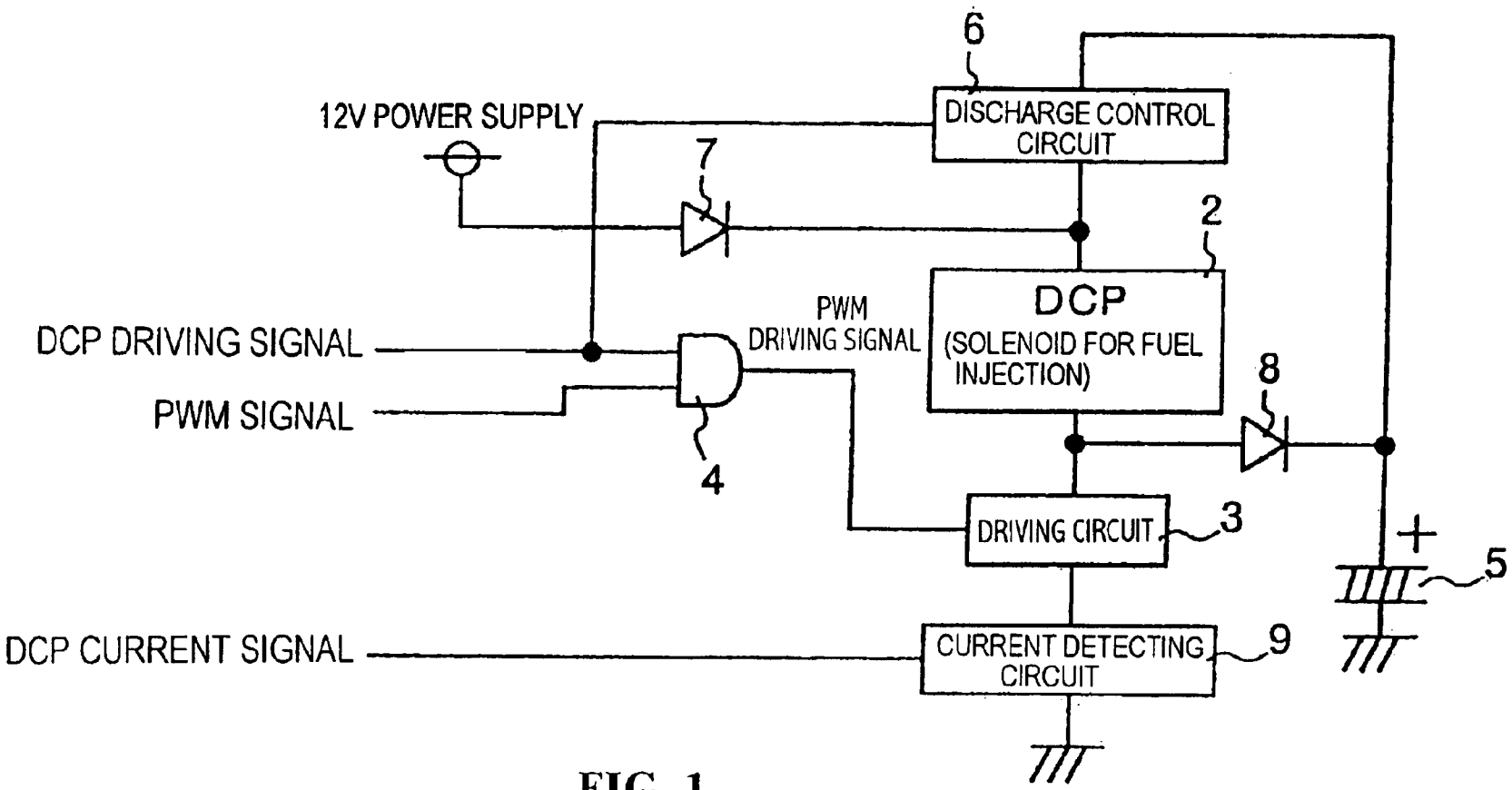
FIG. 1 is a block diagram illustrating a configuration of a fuel injection control apparatus according to the present invention.

FIG. 1 illustrates a configuration of the fuel injection control apparatus according to the present invention. In FIG. 1, a solenoid for fuel injection (hereinafter referred to as a "solenoid" or "DCP") 2 constitutes the plunger pump 202 (FIG. 12). The control apparatus includes a driving circuit 3 for driving the solenoid 2 and a driving signal generating circuit 4 for providing a PWM driving signal to the driving circuit 3.

The fuel injection control apparatus is provided with a capacitor 5 that receives currents passed through the solenoid 2 while storing the energy released from the solenoid 2 in suspending driving of the solenoid 2, a discharge control circuit 6 operable to reuse the energy stored in the capacitor 5 as energy to drive the solenoid again, diodes 7 and 8 operable to prevent the energy stored in the capacitor 5 from flowing back to the driving circuit 3 and the power supply side, and a current detecting circuit 9 that detects a driving current flowing from the solenoid 2 to the ground side in driving the solenoid 2. The driving circuit 3, driving signal generating circuit 4, capacitor 5, discharge control circuit 6, diodes 7 and 8, and current detecting circuit 9 are included in the actuation driver 205 shown in FIG. 12.

FIG. 2 is a schematic circuit diagram showing an example of a configuration of the fuel injection control apparatus according to the present invention. As shown in FIG. 2, the solenoid (DCP) 2 is connected at one end to a cathode terminal of the first diode 7. An anode terminal of the first diode 7 is connected to a power supply terminal of a battery of 12V, for example. In this way, the first diode 7 forms a backflow preventing circuit that prevents the current from flowing back to the power supply side from the load side.

Meanwhile, the solenoid 2 is connected at its other end to a drain terminal of a first N-channel FET 31 and an anode terminal of the second diode 8. A source terminal of the first N-channel FET 31 is grounded via a first resistor 91. The first N-channel FET 31 constitutes a switch (the driving means in the present invention) to provide the driving current to the solenoid. The resistor 91 is used to measure a current that passes through the solenoid 2 and is of low resistance as described later.

A cathode terminal of the second diode 8 is connected to a positive terminal of the first capacitor 5. The first capacitor 5 is operable to charge the energy released in suspending the driving of the solenoid 2. A negative terminal of the first capacitor 5 is grounded. The positive terminal of the first capacitor 5 is connected to a drain terminal of a second N-channel FET 61. A source terminal of the second N-channel FET 61 is connected to one end of the solenoid 2 that is connected to the power supply terminal via the first diode 7. The second N-channel FET 61 connects the positive terminal of the first capacitor to one end of the solenoid 2 to reuse the energy charged on the first capacitor 5 as energy for driving the solenoid 2.

In order to control ON and OFF of the first N-channel FET 31, a microcomputer in the control unit 206 provides a DCP driving signal and a PWM signal. The DCP driving signal is to specify a fuel injection period. The PWM signal is a pulse signal which is generated in the control unit 206 corresponding to a required fuel injection amount required from the engine side, and has a predetermined duty ratio.

A DCP driving signal input terminal 131 is connected to an input terminal of a first inverter 101. An output terminal of the first inverter 101 is pulled up to, for example, DC5V (control voltage) via a second resistor 102, and is connected to a base terminal of a first npn transistor 108 via a third resistor 106. An emitter terminal of the first npn transistor 108 is grounded, while being connected to a base terminal of a fourth resistor 107.

Meanwhile, a PWM signal input terminal 132 is connected to an input terminal of a second inverter 111. An output terminal of the second inverter 111 is pulled up to, for example, 5V via a fifth resistor 112, and is connected to a base terminal of a second npn transistor 41 via a sixth resistor 43. An emitter terminal of the second npn transistor 41 is grounded, while being connected to a base terminal via a seventh resistor 42.

A collector terminal of the first npn transistor 108 and collector terminal of the second npn transistor 41 are both pulled up to, for example, 12V via an eighth resistor 32, while being connected to a gate terminal of the first N-channel FET 31 via a ninth resistor 33. The second npn transistor 41, sixth resistor 43 and seventh resistor 42 constitute a driving prohibitive circuit 4. When the second npn transistor 41 is ON, the gate voltage of the first N-channel FET 31 is set at Low, and the first N-channel FET 31 is turned OFF. The aforementioned first inverter 101, first npn transistor 108, and driving prohibitive circuit 4 constitute the driving signal generating means. The first N-channel FET 31, eighth resistor 32 and ninth resistor 33 constitute the driving circuit 3.

The output terminal of the first inverter 101 is connected to a base terminal of a third npn transistor 105 via a tenth resistor 103. An emitter terminal of the third npn transistor 105 is grounded, while being connected to a base terminal via an eleventh resistor 104. A collector terminal of the third npn transistor 105 is connected to a gate terminal of the second N-channel FET 61 via a twelfth resistor 66. In this way, only when the DCP driving signal is ON, the second N-channel FET 61 constituting the discharge control circuit 6 turns ON.

A connection node of the cathode terminal of the first diode 7 and solenoid 2 is connected to an anode terminal of a Zener diode 62, an anode terminal of a third diode 67 and one terminal of a second capacitor 64. A cathode terminal of the Zener diode 62 is connected to an anode terminal of a fourth diode 63, while being connected to the drain terminal of the second N-channel FET 61 via a sixteenth resistor 68.

A cathode terminal of the third diode 67 is connected to the gate terminal of the second N-channel FET 61. A cathode terminal of the fourth diode 63 is connected to the other terminal of the second capacitor 64, while being connected to a collector terminal of the third npn transistor 105 via a thirteenth resistor 65. The second N-channel FET 61, Zener diode 62, third diode 67, fourth diode 63, twelfth resistor 66, thirteenth resistor 65, sixteenth resistor 68 and second capacitor 64 constitute the discharge control circuit 6.

The terminal connected to the source terminal of the first N-channel FET31 of the resistor 91 is connected to a non-inverse input terminal of an operational amplifier 92. An inverse input terminal of the operational amplifier 92 is connected to the other end of the resistor 91 via a fourteenth resistor 93 and grounded. An output terminal of the operational amplifier 92 is connected to a DCP current signal output terminal 133. A fifteenth resistor 94 and third capacitor 95 are connected in parallel between the inverse input terminal and output terminal of the operational amplifier 92. A positive power supply terminal of the operational amplifier 92 is connected to a fourth capacitor 96. A negative power supply terminal of the operational amplifier 92 is grounded.

The first resistor 91, operational amplifier 92, fourteenth resistor 93, fifteenth resistor 94, third capacitor 95 and fourth capacitor 96 constitute the current detecting circuit 9. The current passed through the solenoid 2 generates a voltage at opposite ends of the resistor 91, and the voltage is amplified in the current detecting circuit 9, and is input to the control unit 206. The output terminal of the operational amplifier 92 is connected to a connection node of a fifth diode 121 and sixth diode 122 in series in the inverse direction between the ground side and a terminal to which a voltage of 5V is applied, for example. The DCP current signal output terminal 133 is connected to a fifth capacitor 123.

The operation of the circuitry shown in FIG. 2 will be described below with reference to FIG. 3.

Figure 3:
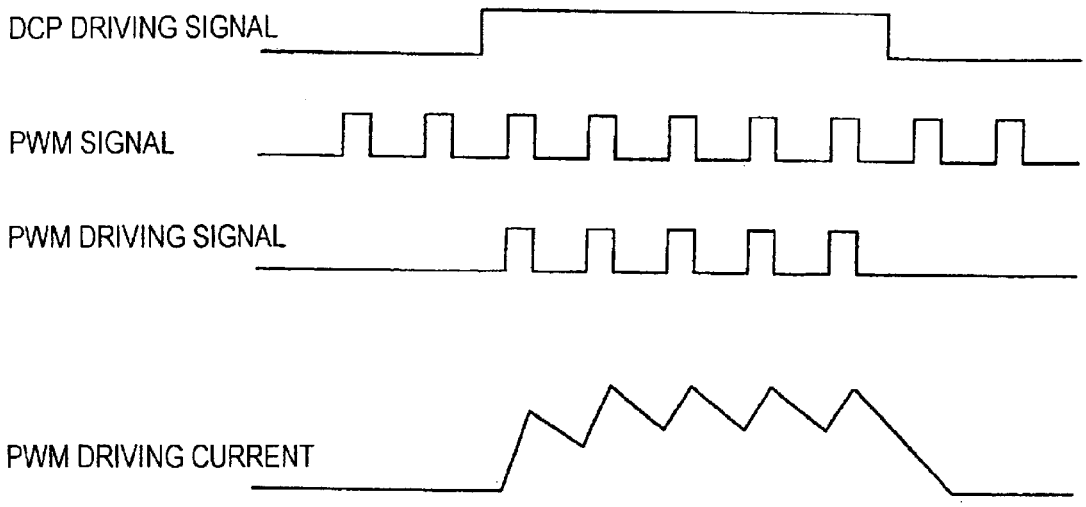
FIG. 3 is a schematic view showing waveforms of a DCP driving signal, a PWM signal, a PWM driving signal and a PWM driving current in the circuitry as shown in FIG. 2.

FIG. 3 is a schematic view showing waveforms of the DCP driving signal, PWM signal, PWM driving signal and PWM driving current. As described above, the DCP driving signal is a pulse signal for specifying a fuel injection period. The PWM signal is varied in its duty arbitrarily in a range of 0 to 100% corresponding to a required fuel injection amount from the engine side. The PWM driving signal is generated based on the DCP driving signal and PWM signal, and is provided to the gate terminal of the first N-channel FET 31. The PWM driving current is a current (solenoid current) passed through the solenoid 2.

In FIGS. 2 and 3, when the DCP driving signal has the low level, since the first npn transistor 108 is ON, the gate voltage of the first N-channel FET 31 has the low level, and the first N-channel FET 31 is OFF. In this state, the current is not fed to the solenoid 2, and the fuel injection does not occur. At this point, since the third npn transistor 105 is also ON, the second N-channel FET 61 is also OFF.

When the DCP driving signal has the high level, the first npn transistor 108 is OFF. At this point, when the PWM signal has the high level, since the second npn transistor 41 is OFF, the gate voltage of the first N-channel FET 31 has the high level. Accordingly, the current is applied to the solenoid 2 from the power supply, and the PWM driving current increases gradually. At this point, since the third npn transistor 105 is OFF, the second N-channel FET 61 is ON.

Meanwhile, when the first npn transistor 108 is OFF and the PWM signal has the low level, since the second npn transistor 41 is ON, the gate voltage of the first N-channel FET 31 has the low level, and the first N-channel FET 31 is OFF. Accordingly, the current is not fed to the solenoid 2 from the power supply side. However, since the second N-channel FET 61 is ON, the fly-wheel current fed to the solenoid 2 at the time of low-level PWN signal is passed through the second diode 8, fed to the second N-channel FET 61, and consumed. Accordingly, the PWM driving current decreases gradually. Since ON-resistance of the second N-channel FET 61 is low, the loss is small and heat generation and others are suppressed.

When the DCP driving signal is switched from the high level to the low level, the first N-channel FET 31 and second N-channel FET 61 both turn OFF from ON. Therefore, the current passed through the solenoid is passed through the second diode 8, fed to the first capacitor 5, and stored therein. In this way, the voltage of the first capacitor 5 rapidly increases, and the current fed to the solenoid 2 becomes zero. Accordingly, the fuel injection is rapidly suspended. Then, the state as described is obtained where the DCP driving signal has the low level.

When the DCP driving signal is switched from the low level to the high level, the first N-channel FET 31 and second N-channel FET 61 both turn ON from OFF. Therefore, the first capacitor 5 causes a discharge, a large current is applied to the solenoid 2 from the first capacitor 5, and the PWM driving current rises abruptly. Thus, the fuel injection response is improved. Then, the state as described above is obtained where the DCP driving signal has the high level.

While the aforementioned operation is performed, the driving current conducted to the ground side from the solenoid 2 through the first N-channel FET 31 is detected as a voltage signal in the first resistor 91 of the current detecting circuit 9. The detected voltage signal is amplified in the operational amplifier 92, provided as a DCP current signal to the microcomputer in the control unit 206, converted into a digital signal, and compared with a target value of the driving current. In order for the current level detected in the current detecting circuit 9 to be coincident with the target value, the duty of the PWM signal is adjusted by the microcomputer. In other words, the feedback control of the driving current is performed.

Figure 4:
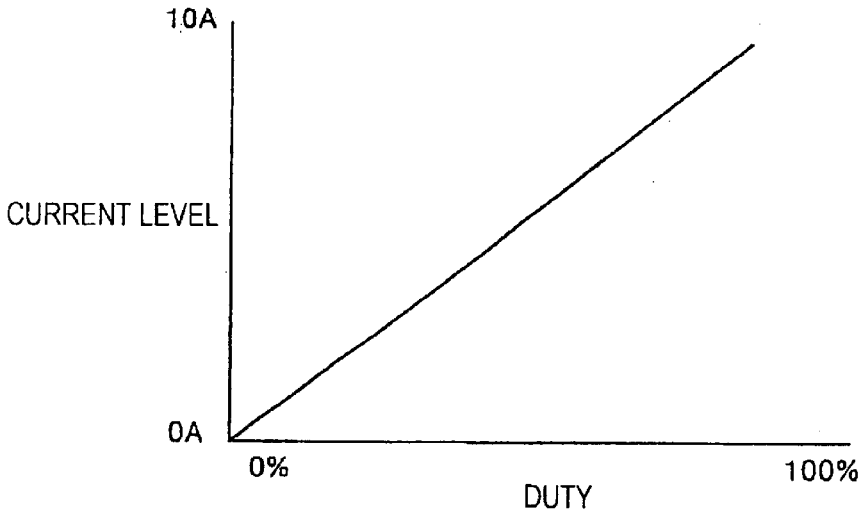
FIG. 4 is a characteristic view showing the relationship between the duty of the PWM signal and the PWM driving current level.

FIG. 4 is a characteristic view showing the relationship between the duty of the PWM signal (PWM driving signal) and the PWM driving current level. The duty of the PWM signal is variable in a range of 0 to 100%, and is selected as appropriate by the microcomputer. As shown in FIG. 4, when the duty of the PWM signal varies in a range of 0 to 100%, the duty of the PWM driving signal also varies in a range of 0 to 100%, and corresponding to the variation, the PWM driving current varies from 0 A to the maximum current (for example 10 A). In other words, according to this embodiment, by adjusting the duty of the PWM signal, it is possible to adjust the PWM driving current. Using such an adjustment, in this embodiment, a variety of current control as described below is combined and performed as appropriate when necessary.

Figure 5:
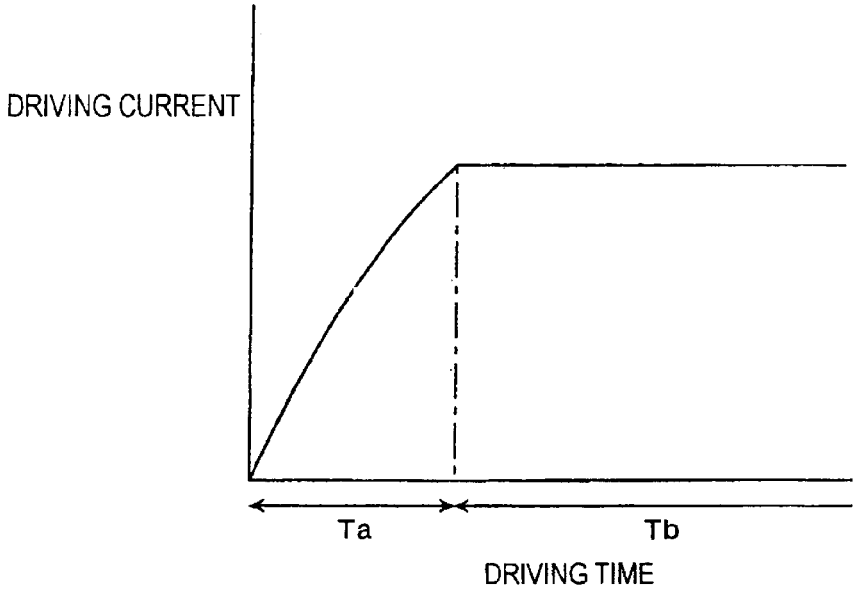
FIG. 5 is a schematic view showing variations in the driving current with driving time when constant current control is performed in the fuel injection control apparatus.
Figure 9:
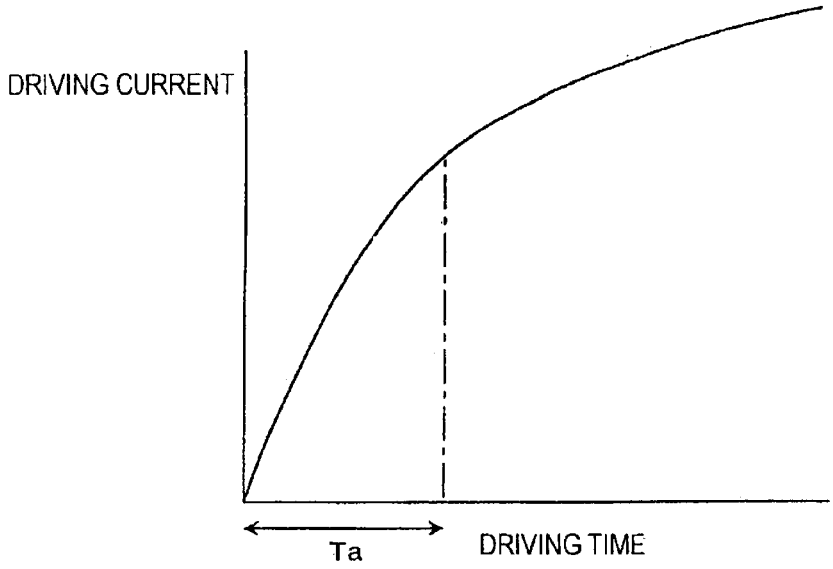
FIG. 9 is a schematic view showing variations in the driving current with driving time when the constant current control is not performed in the fuel injection control apparatus, to compare with FIG. 5.

As a first embodiment of current control, as shown in FIG. 5, a constant current period Tb is provided subsequent to a current increasing period Ta during which the PWM driving current rises abruptly due to a discharge of the first capacitor 5 and reaches a minimum current level required for driving the solenoid 2. During the constant current period Tb, such control is performed so that the minimum constant current required for driving the solenoid 2 is fed to the solenoid 2. When such control is not performed, as shown in FIG. 9, the current increases with the time constant due to the inductance and resistance of the solenoid 2 after the current increasing period Ta, resulting in wasted currents corresponding to amounts exceeding the minimum current level required for driving the solenoid 2, i.e. amounts exceeding the current level for starting the fuel injection. Thus, according to this embodiment, it is possible to eliminate wasted driving currents.

Figure 6:
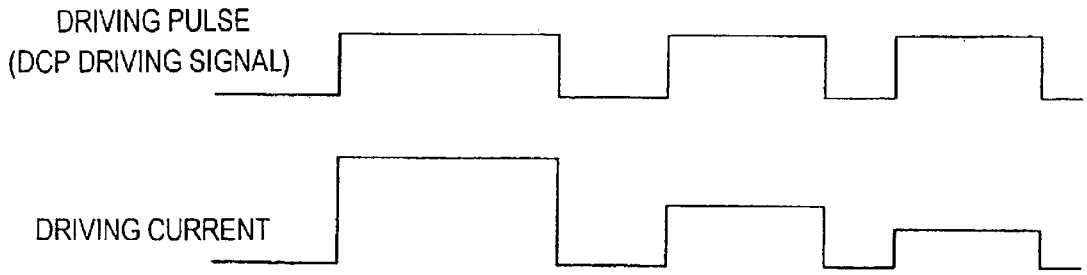
FIG. 6 is a schematic view showing waveforms of a driving pulse and a driving current when control is performed for decreasing the driving current at a low-load operation in the fuel injection control apparatus.
Figure 10:
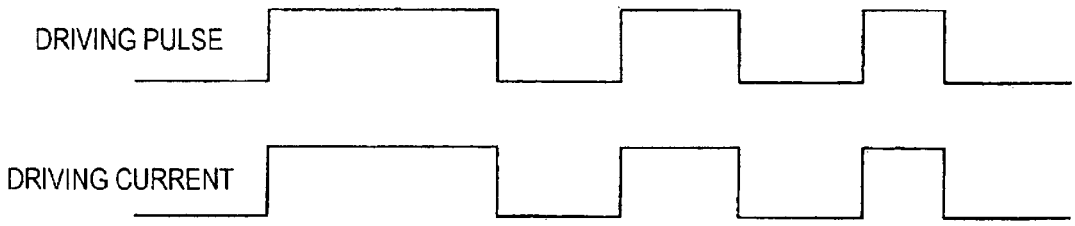
FIG. 10 is a schematic view showing waveforms of the driving pulse and driving current when the control is not performed for decreasing the driving current at low-load operation in the fuel injection control apparatus, to compare with FIG. 6.

As a second embodiment of current control, as shown in FIG. 6, such control is performed so that the driving current applied to the solenoid 2 is suppressed to a low level at a low-load engine operation. In this way, at a low-load engine operation, the fuel injection amount per unit time is decreased, and it is thereby possible to widen a pulse width of the DCP driving signal. When such current control is not performed, the driving pulse width is narrow as shown in FIG. 10, and the accuracy in the fuel injection amount is low. Thus, according to this embodiment, it is possible to improve the accuracy in flow rate at a low-load operation and to widen the dynamic range of the fuel injection amount.

As a third embodiment of current control, such control is performed so that a current level in the constant current control is varied as appropriate in one stroke of the engine. It is thereby possible to vary the fuel injection amount per unit time as appropriate in one stroke of the engine. Thus, according to this embodiment, it is possible to obtain optimal fuel injection patterns such that, for example, fuel injection is performed corresponding to intake air as a conventional carburetor and that the fuel is injected to an engine inlet valve of high temperature in steps other than the inlet step so as to accelerate gasifying of fuel as emission control measures.

As a fourth embodiment of current control, such control is performed so that the driving current applied to the solenoid 2 is set, for example, at maximum, when acceleration is detected during the engine operation and an increased amount is required for the acceleration. It is thereby possible to inject a larger amount of fuel in a short time during the acceleration, and therefore, delays in increasing the amount for acceleration can be prevented. Thus, according to this embodiment, fuel control characteristics at acceleration operation are improved. Further, by controlling levels of the driving current applied to the solenoid 2 corresponding to the degree of acceleration, it is also possible to inject an amount of fuel corresponding to the degree of acceleration.

Figure 7:
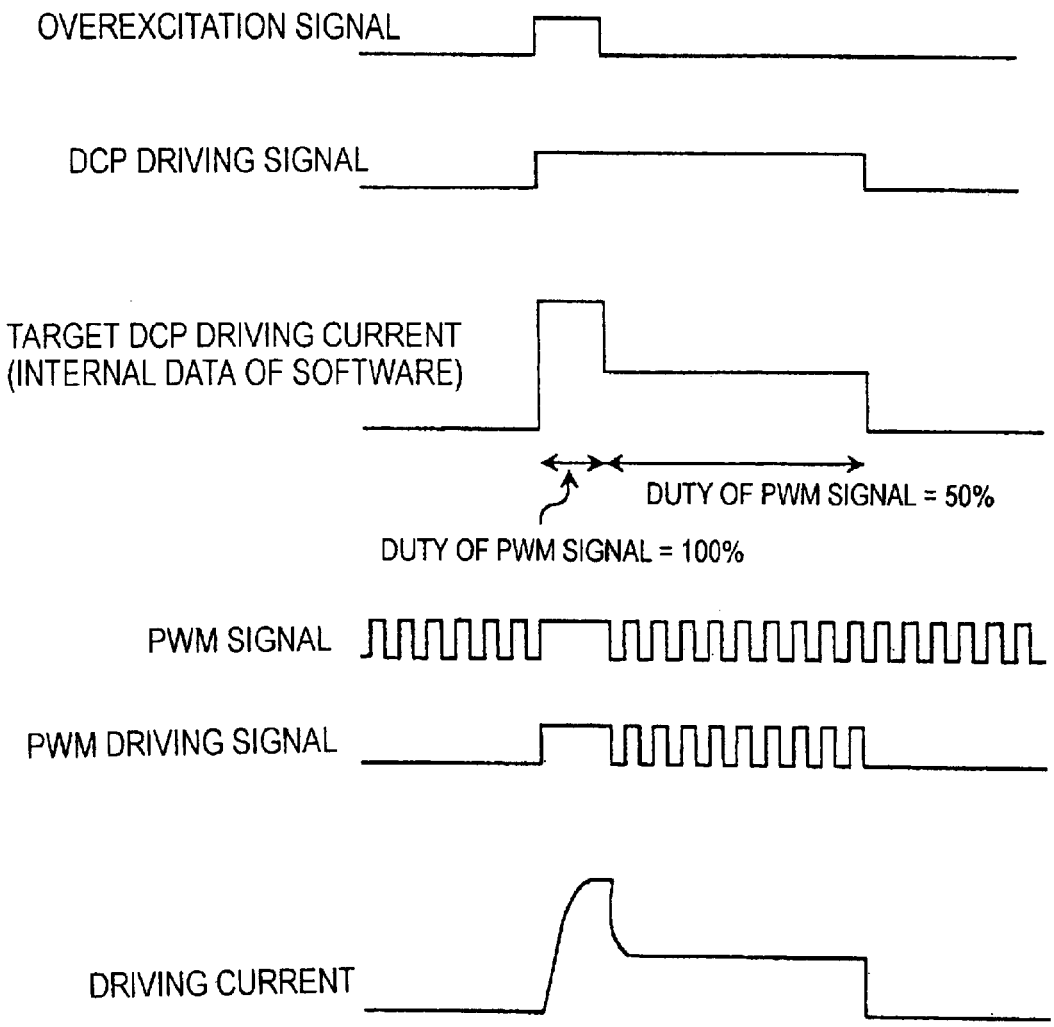
FIG. 7 is a schematic view showing waveforms of the DCP driving signal, the PWM signal, the PWM driving signal, the driving current and others when overexcitation is performed in the fuel injection control apparatus.

As a fifth embodiment of current control, as shown in FIG. 7, overexcitation control is performed such that a large driving current is applied to the solenoid for a predetermined time at the time the driving current rises. This control is achieved by setting the duty of the PWM signal, for example, at 100% at the time the driving current rises and setting the duty at 50% after a lapse of predetermined time, according to a target level of the driving current (target DCP driving current) stored in ROM or other storage device as internal data in the microcomputer. It is thereby possible to implement fast current control. In addition, the overexcitation signal shown in FIG. 7 is a signal indicative of the timing at which the driving current is increased for a predetermined time.

Figure 8:
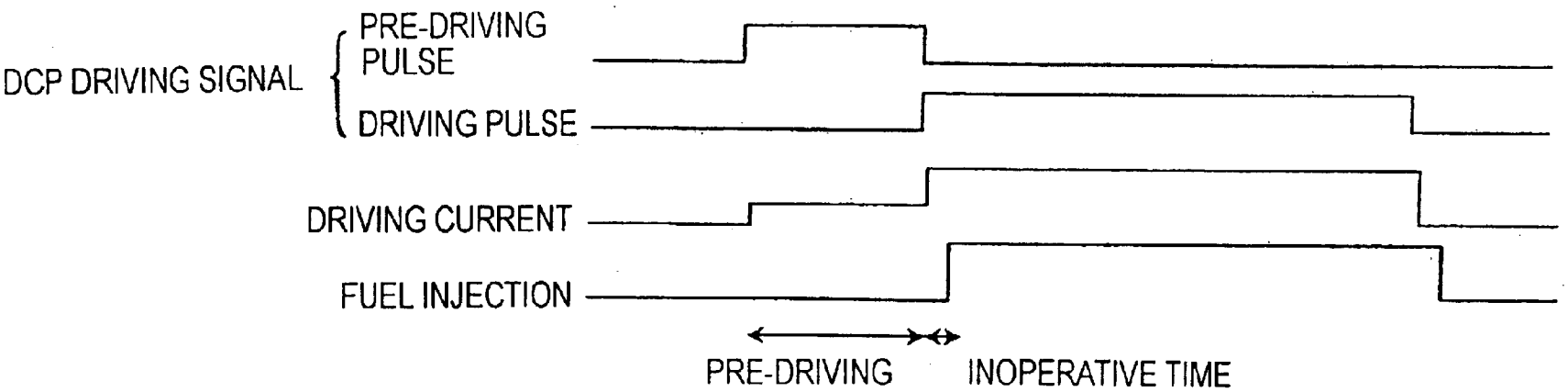
FIG. 8 is a schematic view showing waveforms of a pre-driving pulse, a driving pulse, a driving current and fuel injection when pre-driving is performed in the fuel injection control apparatus.

As a sixth embodiment of current control, as shown in FIG. 8, such control is performed so that the current is applied to the solenoid 2 to the extent of not causing the fuel injection before the fuel is actually injected. This control is achieved by first providing a pulse signal (referred to as a pre-driving pulse) for applying the current of the extent of not causing the fuel injection, and then providing the pulse signal (driving pulse) to cause the fuel injection, to the solenoid 2.

At the time of providing the pre-driving pulse, since the duty of the PWM signal is small, the current of the extent of not causing fuel injection is applied to the solenoid 2, and the solenoid 2 is driven in a range of not injecting the fuel. Thereby, the purge step and pressurizing step of the electromagnetic fuel injection apparatus are almost finished before the fuel injection. Then, at the time the purge step and pressurizing step are almost finished, by providing the pulse signal (driving pulse) for injecting the fuel, the current of the extent of causing fuel injection is applied to the solenoid 2, and the fuel is injected.

Figure 11:
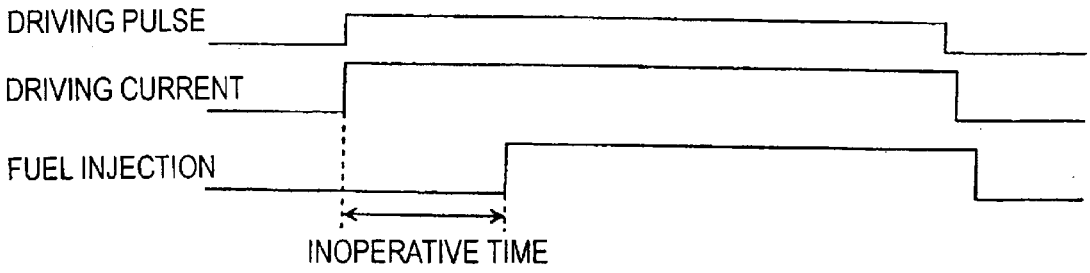
FIG. 11 is a schematic view showing waveforms of the driving pulse, driving current and fuel injection when the pre-driving is not performed in the fuel injection control apparatus, to compare with FIG. 8.

In this way, the inoperative time is greatly reduced which is taken to start actual fuel injection after providing the driving pulse for injecting the fuel. When such pre-driving current control is not performed, as shown in FIG. 11, the inoperative time is long and the accuracy in fuel control deteriorates, in particular, when the flow rate is small such as at idle operation. Thus, according to this embodiment, it is possible to prevent the accuracy in fuel control from deteriorating. In particular, this embodiment is effective to prevent the accuracy in fuel control from deteriorating at idle operation or the like.

The process flow of a fuel injection control method according to the present invention will be described based on flowcharts.

Figure 13:
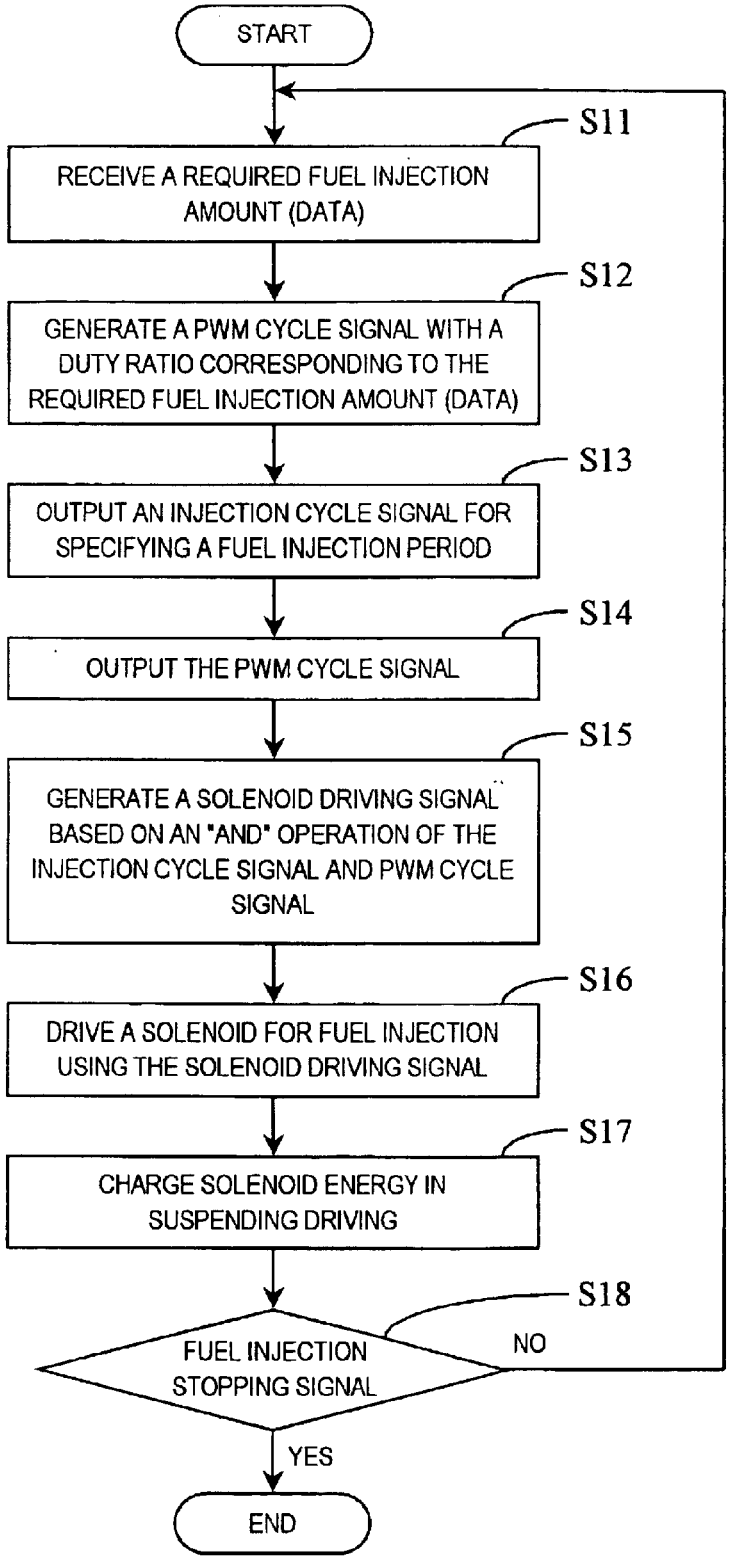
FIG. 13 shows an example of a flowchart for describing a basic process of a fuel injection control method according to the present invention.

FIG. 13 illustrates the basic process of the fuel injection control method. For example, power is supplied to the fuel injection control apparatus, and thus the control program starts.

The microprocessor (the control apparatus) constituting the control unit 206 (FIG. 12) receives data indicative of a required fuel injection amount to cause an optimal driving output corresponding to a load state or other state of the internal combustion engine from the outside (for example, the engine side) (step 11). Next, a PWM cycle signal is generated which has a duty ratio corresponding to the received required fuel injection amount (data) (step 12). The correspondence relationship between the required fuel injection amount (data) and duty ratio is stored in advance in a memory constituting the control apparatus.

The control apparatus outputs to the driving signal generating means ("4" in FIG. 1) an injection cycle signal for specifying a fuel injection period and the PWM cycle signal generated as described above (steps 13 and 14). The driving signal generating means perform "AND" operation of the injection cycle signal and the PWM cycle signal to generate a solenoid driving signal (step 15). The solenoid driving signal is output to the driving circuit ("3" in FIG. 1), and the DCP (solenoid) 2 is actuated (step 16). The energy generated by the DCP (solenoid) 2 in suspending the driving is charged on the capacitor 5 (step 17), and is reused as the energy for subsequent driving of the DCP (solenoid). Then, by power shutdown of the control circuit or the like, a fuel injection stopping signal is input (step 18) and thus the control flow ends.

Figure 14:
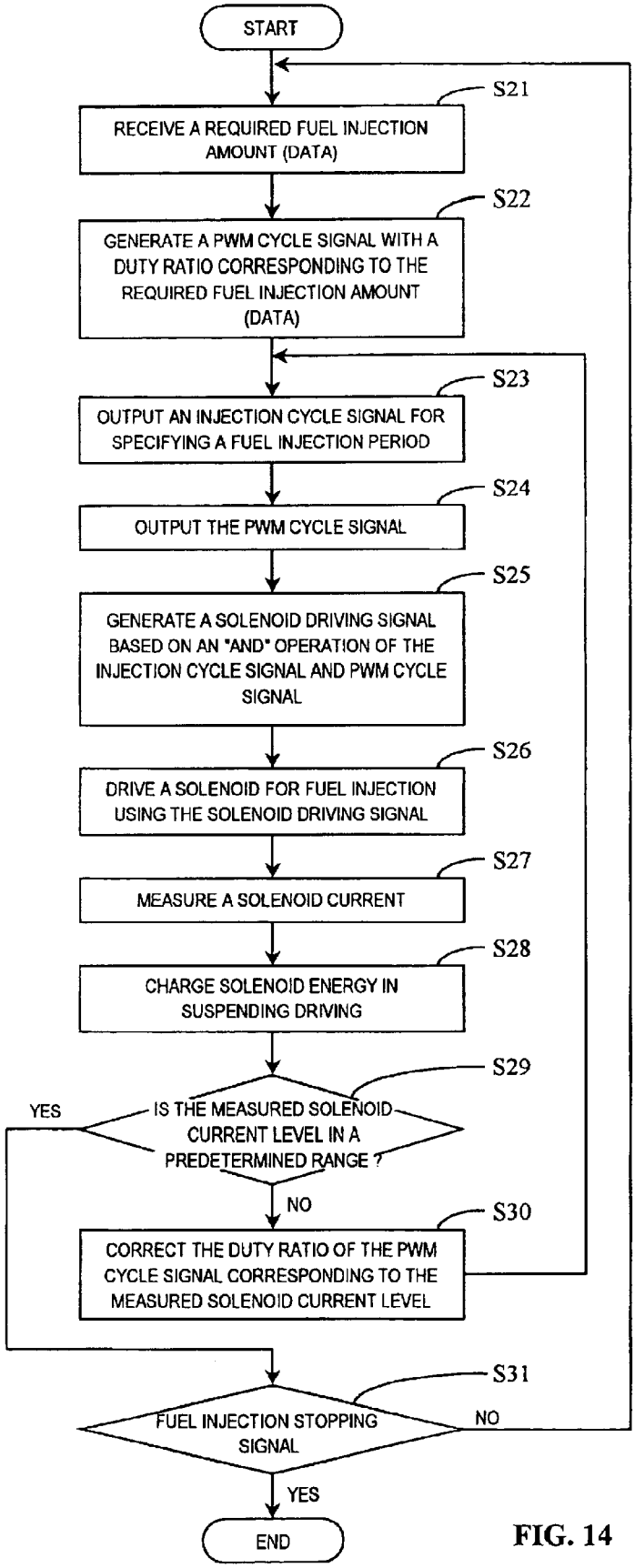
FIG. 14 shows an example of a flowchart for correcting the duty ratio of the PWM cycle signal using a measured solenoid current level in the basic process of the fuel injection control method.
Figure 15:
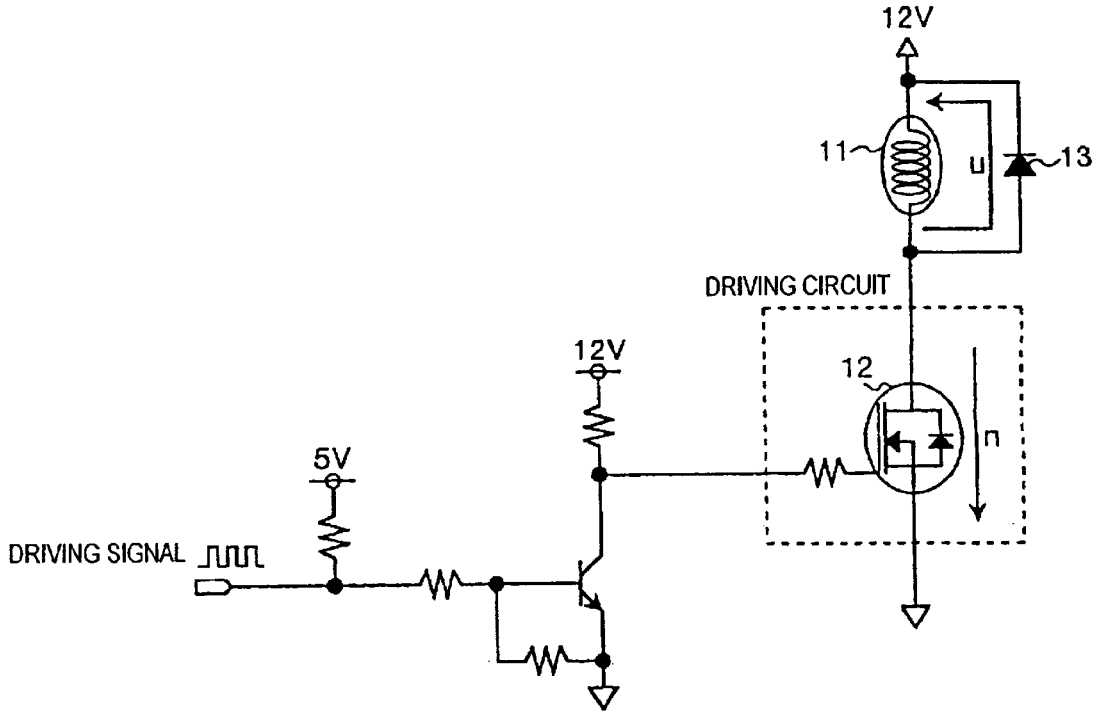
FIG. 15 Prior Art
FIG. 15 is a schematic circuit diagram which depicts a PWM driving method in a conventional type of fuel injection apparatus.
Figure 16:
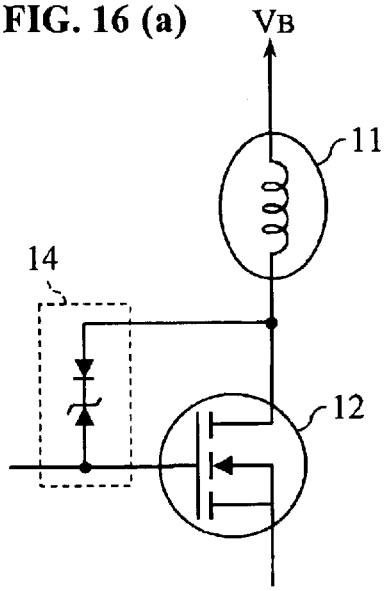
FIGS. 16(*a*) to 16(*d*) show examples of snubber circuits to consume energy caused by suspending a driving of a solenoid for fuel injection.
Figure 16:
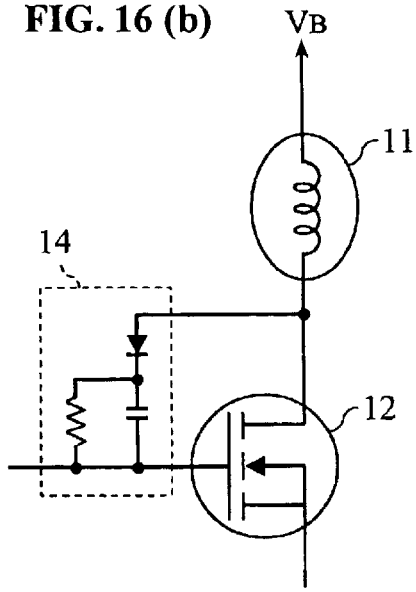
Figure 16:
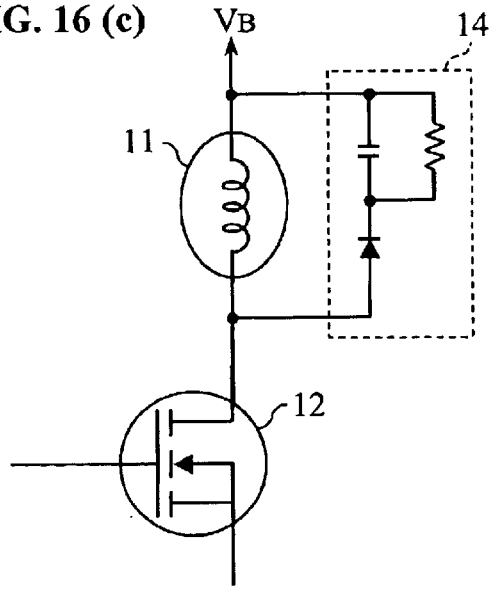
Figure 16:
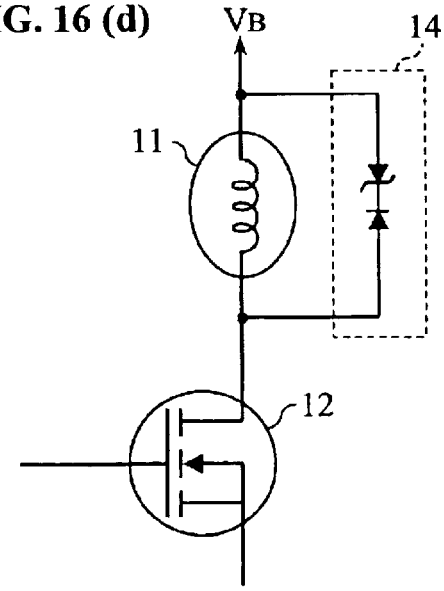

FIG. 14 illustrates a control flow of constantly measuring the solenoid current and based on the measured level, adjusting the solenoid driving time or others in the basic process illustrated in FIG. 13 of the fuel injection control method.

In the process illustrated in FIG. 13, for example, power is supplied to the fuel injection control apparatus, and the control program starts. The control apparatus receives data indicative of a required fuel injection amount to cause an optimal driving output corresponding to a load state or other state of the internal combustion engine from the outside (step 21), and generates a PWM cycle signal with a duty ratio corresponding to the received required fuel injection amount (data) (step 22).

The control apparatus outputs to the driving signal generating means an injection cycle signal for specifying a fuel injection period (step 23), while outputting the PWM cycle signal generated as described above (step 24). The driving signal generating means perform an "AND" operation of the injection cycle signal and the PWM cycle signal to generate a solenoid driving signal (step 25), and using the solenoid driving signal, the driving circuit actuates the DCP (solenoid) 2 (step 26).

At this point, the control apparatus measures the solenoid current (step 27). In FIG. 13, the energy caused by suspending the driving of the DCP (solenoid) is charged on the capacitor 5 every time (step 28). Based on the solenoid current level measured in step 27, it is determined whether or not to correct the duty ratio of the PWM signal generated in step 22 (step 29). For example, this determination is made by judging whether or not the solenoid current level is in a range estimated in advance corresponding to the required fuel injection amount. When determining that the correction is required, the duty ratio of the PWM cycle signal is corrected (step 30), and the DCP (solenoid) is driven and controlled using the PWM cycle signal with the corrected duty ratio. Then, by power shutdown of the control circuit or the like, a fuel injection stopping signal is input (step 31), and thus the control flow ends.

The present invention is not limited to the above-mentioned embodiments, and is capable of being carried into practice with various modifications thereof. For example, instead of generating PWM signals in the microcomputer, a circuit for generating PWM signals may be provided to generate PWM signals. Further, instead of comparing the DCP current signal with a target level of the driving current in the microcomputer, a comparing circuit for comparing the signal with the target level may be provided to perform the comparison.

As described specifically, the fuel injection control apparatus according to the present invention has driving signal generating means for generating a solenoid driving signal based on an injection cycle signal for specifying a fuel injection period and PWM cycle signal to provide to a driving means, and control means for generating the PWM cycle signal with a duty ratio corresponding to a required fuel injection amount, and providing the PWM cycle signal and the injection cycle signal to the driving signal generating means. Thus, in the present invention, by using two signals, i.e., the injection cycle signal for specifying a fuel injection period and the PWM cycle signal with a duty ratio corresponding to a required fuel injection amount, precisely controlling the fuel injection amount is achieved, and further the fuel injection control is achieved which enables quick response to variations in required fuel injection amount.

The fuel injection control apparatus according to the present invention further has a discharge control circuit that charges the energy released by suspending the driving of the solenoid for fuel injection, and by reusing the energy released from the solenoid, achieves both improved energy efficiency of the engine system and reduced battery capacity.

INDUSTRIAL APPLICABILITY

The present invention relates to an electronic fuel injection control method and apparatus for providing fuel to an internal combustion engine, and more particularly, a fuel injection control method and apparatus for promptly responding to variations in required fuel injection amounts required from the internal combustion engine and precisely injecting the required fuel injection amounts. Therefore, the present invention has industrial applicability.

What is claimed is:

1. A fuel injection control apparatus which controls an electromagnetic fuel injection apparatus that pressurizes fuel to inject, comprising:

driving means for driving a solenoid for fuel injection;

driving signal generating means for generating a solenoid driving signal based on an injection cycle signal for specifying a fuel injection period and a PWM cycle signal to provide to the driving means; and control means for generating the PWM cycle signal with a duty ratio corresponding to a required fuel injection amount, and providing the PWM cycle signal and the injection cycle signal to the driving signal generating means.

2. The fuel injection control apparatus according to claim 1, wherein the duty ratio of the PWM cycle signal is maintained at a constant value during a period of one fuel injection cycle.

3. The fuel injection control apparatus according to claim 2, further comprising:

coil current detecting means for measuring a coil current passed through the solenoid for fuel injection, wherein corresponding to the measured coil current level, the control means adjusts the duty ratio of the PWM cycle signal.

4. The fuel injection control apparatus according to claim 1, wherein the control means varies the duty ratio of the PWM cycle signal during a period of one fuel injection cycle.

5. The fuel injection control apparatus according to claim 4, further comprising:

coil current detecting means for measuring a coil current passed through the solenoid for fuel injection, wherein corresponding to the measured coil current level, the control means adjusts the duty ratio of the PWM cycle signal.

6. The fuel injection control apparatus according to claim 1, further comprising:

a capacitor that is coupled to charge energy released by suspending driving of the solenoid for fuel injection; and a discharge control circuit that is provided to reuse the energy charged on the capacitor as energy for driving the solenoid.

7. The fuel injection control apparatus according to claim 6, wherein the discharge control circuit comprises switching means for providing the energy charged on the capacitor to the solenoid when a voltage exceeding a power supply voltage is charged on the capacitor and the injection cycle signal is ON.

8. The fuel injection control apparatus according to claim 1, wherein the control means provides to the driving means a solenoid driving signal in a range of not causing the fuel injection before outputting the injection cycle signal for specifying the fuel injection period.

9. A fuel injection control method for controlling an electromagnetic fuel injection apparatus that pressurizes fuel to inject, comprising the steps of:

generating a PWM cycle signal with a duty ratio corresponding to a required fuel injection amount;

outputting the PWM cycle signal with an injection cycle signal for specifying a fuel injection period;

generating a solenoid driving signal based on the injection cycle signal and the PWM cycle signal; and driving a solenoid for fuel injection using the solenoid driving signal.

10. The fuel injection control method according to claim 9, wherein the duty ratio of the PWM cycle signal is maintained at a constant value during a period of one fuel injection cycle.

11. The fuel injection control method according to claim 9, wherein the duty ratio of the PWM cycle signal is varied during a period of one fuel injection cycle.

12. The fuel injection control method according to claim 9, further comprising the steps of:

charging energy released by suspending driving of the solenoid for fuel injection; and providing the charged energy to the solenoid for fuel injection during the fuel injection period, wherein the energy is reused as energy for driving the solenoid.

13. The fuel injection control method according to claim 9, further comprising the step of:

driving the solenoid for fuel injection, first using a solenoid driving signal in a range of not causing the fuel injection.

14. A fuel injection control method for controlling an electromagnetic fuel injection apparatus that pressurizes fuel to inject, comprising the steps of:

generating a PWM cycle signal with a duty ratio corresponding to a required fuel injection amount;

outputting the PWM cycle signal with an injection cycle signal for specifying a fuel injection period;

generating a solenoid driving signal based on the injection cycle signal and the PWM cycle signal;

driving a solenoid for fuel injection using the solenoid driving signal;

measuring a coil current passed through the solenoid for fuel injection; and adjusting the duty ratio of the PWM signal, corresponding to the measured coil current level.

15. The fuel injection control method according to claim 14, wherein the duty ratio of the PWM cycle signal is maintained at a constant value during a period of one fuel injection cycle.

16. The fuel injection control method according to claim 14, wherein the duty ratio of the PWM cycle signal is varied during a period of one fuel injection cycle.

17. The fuel injection control method according to claim 14, further comprising the steps of:

charging energy released by suspending driving of the solenoid for fuel injection; and providing the charged energy to the solenoid for fuel injection during the fuel injection period, wherein the energy is reused as energy for driving the solenoid.

18. The fuel injection control method according to claim 14, further comprising the step of:

driving the solenoid for fuel injection, first using a solenoid driving signal in a range of not causing the fuel injection.

* * * * *